US005497611A

United States Patent [19]

Benz et al.

[11] Patent Number: 5,497,611

[45] Date of Patent: Mar. 12, 1996

[54] PROCESS FOR THE COOLING OF AN AUTO-IGNITION COMBUSTION CHAMBER

[75] Inventors: Urs Benz, Gipf-Oberfrick; David Walhood, Nussebaumen; Burkhard Schulte-Werning, Basel, all of Switzerland

[73] Assignee: ABB Management AB, Baden, Switzerland

[21] Appl. No.: 383,438

[22] Filed: Feb. 3, 1995

[30] Foreign Application Priority Data

Feb. 18, 1994 [CH] Switzerland ..... 496/94

[51] Int. Cl.[6] ..... F02C 7/16

[52] U.S. Cl. ..... 60/39.06

[58] Field of Search ..... 60/39.02, 39.06, 60/752, 754, 756, 760

[56] References Cited

U.S. PATENT DOCUMENTS

| | | | |
|---|---|---|---|
| 3,169,367 | 2/1965 | Hussey | 60/760 |
| 3,623,711 | 11/1971 | Thorstenson | 60/754 |
| 3,937,007 | 2/1976 | Kappler | 60/39.06 |
| 5,012,645 | 5/1991 | Reynolds | 60/756 |
| 5,123,248 | 6/1992 | Monty et al. | 60/754 |

FOREIGN PATENT DOCUMENTS 0161561 11/1985 European Pat. Off. .

*Primary Examiner*—Timothy S. Thorpe
*Attorney, Agent, or Firm*—Burns, Doane, Swecker & Mathis

[57] ABSTRACT

In a combustion chamber which consists essentially of an inflow zone and a combustion zone, the working gases flowing at high temperature into the combustion chamber are mixed with a fuel, in such a way that the latter initiates auto-ignition. Whilst the inflow zone is cooled by effusion cooling, convective cooling is adopted in the combustion zone, the cooling air for the last-mentioned cooling being used at the same time as cooling air for the effusion cooling.

7 Claims, 1 Drawing Sheet

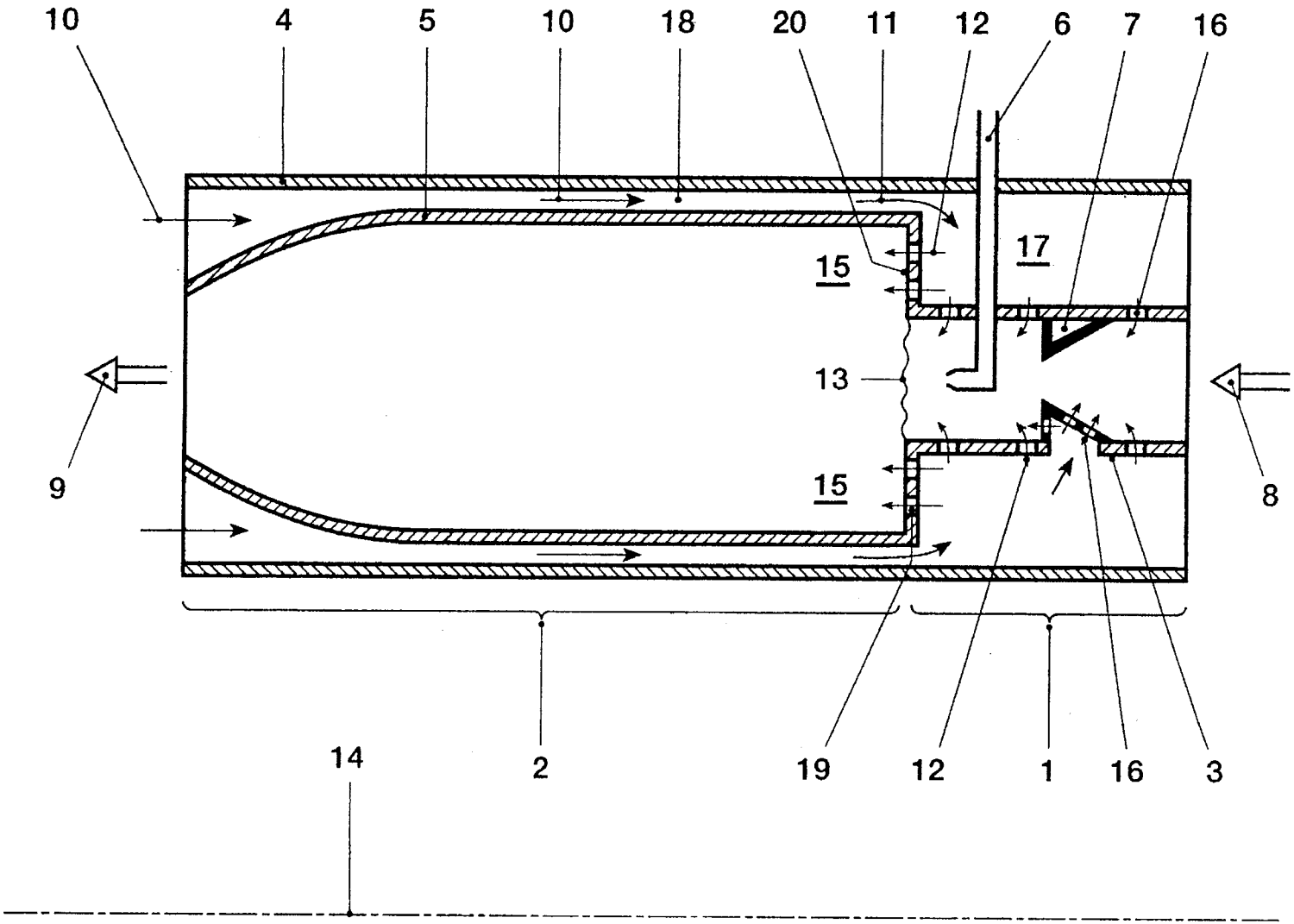
8
16
7
6
12
11
20
18
10
5
4
10
9
3
16
1
12
19
2
14
17
15
13
15

PROCESS FOR THE COOLING OF AN AUTO-IGNITION COMBUSTION CHAMBER

BACKGROUND OF THE INVENTION

1. Field of the Invention

The invention relates to a process for cooling an auto-ignition combustion chamber.

2. Discussion of Background

In the combustion chambers used hitherto in gas-turbine construction, almost the entire mass flow of air of the compressor can be utilized to cool the combustion-chamber walls for the purpose of avoiding excessively high material temperatures. Only a small fraction of this mass flow of air passes into the combustion chamber, without previously having been employed for cooling. In such a type of cooling, the optimization of the cooling lies in working with as small a pressure loss as possible along the cooling stage, so that the efficiency of the gas-turbine plant does not suffer any collapse.

In contrast, in an auto-ignition combustion chamber which takes effect preferably downstream of a first turbine, its smoke gases naturally cannot be employed for cooling purposes on account of the prevailing high temperature. On the other hand, such a combustion chamber already undergoes a high heat load in the inflow zone, so that, even there, cooling has to be extremely efficient. The same also applies increasingly to the downstream combustion zone, where an even higher heat load prevails. In view of this, a high mass flow of air at low temperature would have to be extracted from the process for the purpose of cooling such an auto-ignition combustion chamber. It is necessary, at the same time, to bear in mind that gas-turbine sets of the current high-performance class can generally release only a little air for cooling purposes, since the efficiency and specific power would otherwise drop markedly. This has repeatedly given rise to proposals which postulate a cooling of the assemblies subject to a high heat load by means of other media from outside. First and foremost is the proposal to carry out the cooling by means of steam. If the gas-turbine set is integrated into a combination plant having a steam circuit, then such proposals are certainly worth examining. However, where no steam or media otherwise suitable for cooling exists, a cooling of the auto-ignition combustion chamber can be obtained only at the expense of losses of efficiency.

SUMMARY OF THE INVENTION

The invention intends to remedy this. The object on which the invention, as defined in the claims, is based is, in a process of the type mentioned in the preamble, to propose an efficient cooling with a minimized internal mass flow of air.

The essential advantages of the invention are to be seen in that the cooling of the combustion chamber can be carried out with a minimized loss of the efficiency and specific power of the gas-turbine set. The type of cooling is adapted to the respective combustion characteristics within the combustion chamber and is carried out in such a way that, after work has ended, the mass flow of cooling air used becomes in a suitable way an integral part of the hot gases of this very combustion chamber.

If the auto-ignition combustion chamber consists of an inflow zone and a combustion zone, effusion cooling is selected for the former and convective cooling for the latter. In order to guarantee the desired premixing combustion low in harmful substances in the combustion zone, no cooling techniques based on a controlled introduction of air into this zone, for example film cooling, are adopted.

Effusion cooling involves providing in the burner wall holes which are arranged close to one another in a row and through which the cooling air delivered passes into the interior of the combustion chamber and thus cools the combustion-chamber wall. On the inside of the combustion chamber, this cooling air then forms a thin thermal insulation layer which reduces the heat load on the walls and which guarantees a large-area introduction of cooling air into the main mass flow with a good degree of mixing-in. In addition, this effusion cooling ensures that the flame front cannot flash back upstream from the combustion zone, which can easily be possible per se, since the flow velocity of the combustion air has minimal values, particularly in the wall boundary layers on the inner liner of the inflow zone, and there a creeping back of the premixing flame out of the combustion zone constitutes a potential risk.

The convective cooling adopted for the combustion zone is preferably designed on the countercurrent principle, and, of course, it is also possible to provide co-current cooling or combinations of both. A characteristic of this cooling is its design, according to which there are formed on the circumference of the outer combustion-chamber wall, in the longitudinal direction of the combustion zone, throughflow paths which closely succeed one another and the radial depth of which is the cooling-channel height, thus affording an extremely efficient cooling of the combustion-chamber wall subjected to high thermal load.

In convective cooling of the combustion zone of the countercurrent principle, this cooling air can be transferred in a manner optimum in terms of flow into a pre-space of the inflow zone, from where the above-described effusion cooling can commence.

In an auto-ignition combustion chamber cooled in this way, the ratio of the cooling air required to the mass flow flowing through the combustion chamber can be reduced to below 10%, without running the risk that excessive mechanical loads on the combustion-chamber walls will occur as a result of the pressure loss along the stages to be cooled.

Advantageous and expedient developments of the solution according to the invention for achieving the object are defined in the further dependent claims.

An exemplary embodiment of the invention is explained in more detail below by means of the drawing. All elements not required for the immediate understanding of the invention are omitted. The direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein the single figure shows a cooled combustion chamber which is designed as a postcombustion chamber of a gas-turbine set, combustion being based on auto-ignition.

DESCRIPTION OF THE PREFERRED EMBODIMENTS

Referring now to the drawing, the figure shows a combustion chamber which can be used, for example, as a second combustion chamber of a gas-turbine set and which functions on an auto-ignition principle. This combustion chamber has preferably essentially the form of a continuous annular axial or quasi-axial cylinder, this emerging from the marked center axis 14. The combustion chamber includes an inflow zone 1 and a downstream combustion zone 2. This combustion chamber can, of course, also consist of a number of axially, quasi-axially or helically arranged combustion spaces closed on themselves. If the combustion chamber is designed for auto-ignition, the turbine acting upstream and not shown is designed only for the part expansion of the working gases 8, as a result of which these still have a very high temperature. With such an operating mode and with an annular configuration of the combustion chamber, there are arranged in the circumferential direction of the annular cylinder forming the combustion chamber a plurality of fuel lances 6 which are connected to one another for the supply of fuel, for example via a ring conduit not shown. This combustion chamber therefore has no burners: the fuel jetted into the working gases 8 by the lance 6 initiates an auto-ignition, insofar as the working gases 8 have that specific temperature which can initiate this very auto-ignition. If the combustion chamber is operated with a gaseous fuel, a temperature of the working gases 8 from the upstream turbine of around 1000° C. can be considered as a typical value for auto-ignition. In order to guarantee operating reliability and high efficiency in such a combustion chamber designed for auto-ignition, it is important that the flame front 13 should remain stable in place during the entire operation. For this purpose, on the one hand, a row of vortex-generating elements 7, which induce a backflow zone in the region of the flame front 13, is provided upstream of the fuel lance 6 on the inside and in the circumferential direction of the inner wall 3 of the inflow zone 1. On the other hand, there is provided in the radial plane relative to the flame front 13 a cross-sectional jump 15 which is symmetrical in relation to the cross section of the inflow zone 1 and the size of which at the same time forms the flow cross section of the combustion zone 2. During operation, backflow zones form within this cross-sectional jump 15 and lead, in turn, to an annular stabilization of the flame front 13. Since, on account of the axial arrangement and the overall length kept extremely short, such a combustion chamber is a high-velocity combustion chamber, the mean velocity of which is higher than 60 m/s, the vortex-generating elements 7 must be shaped according to the flow. Since the heat load on this combustion chamber is very high, the cooling must be extremely efficient. At the same time, as already mentioned, it must be remembered that gas-turbine sets of the high-performance classes can, in general, release only a little air for cooling purposes, whilst the efficiency and specific power should not drop markedly. The cooling of this combustion chamber takes place by employing different types of cooling in between the inflow zone 1 and combustion zone 2. In the first place, the cooling of the combustion zone 2 is carried out on the countercurrent principle: a quantity of cooling air 10 flows along a cooling-air channel 18, which is formed by the inner wall 5 and an outer wall 4 of the combustion zone 2, to the inflow zone 1 and cools by convection the inner wall 5, subjected to high heat load, of this zone. The optimization of the cooling in the region of the combustion zone 2 takes place by an appropriate adaptation of the height of the cooling-air channel 18, by a specific surface roughness of the inner wall 5 to be cooled, by various ribbings along the stage to be cooled, etc., the already mentioned possibility of providing axial through-flow paths in the circumferential direction of the inner wall 5 providing good results. The convective cooling for the combustion zone 2 can occasionally be supplemented by impact cooling, and in this connection it must be borne in mind that the pressure of the cooling air 10 should not fall too low. After the first cooling has been carried out, the now partially heat-loaded cooling air 11 flows into a pre-space 17 which extends axially parallel to the inflow zone 1 and which is formed by the inner wall 3 of the inflow zone 1 and by the already acknowledged outer wall 4. However, this cooling air 11 still has a high cooling potential, so that the inflow zone 1, which is subjected to a lower heat load in relation to the combustion zone 2, can likewise be cooled to an optimum degree. For the inflow zone 1, the cooling is carried out in that a large part of said cooling-air stream 11 flows into the interior of the inflow zone 1 via a large number of orifices 16 in the inner wall 3. A small part of the cooling-air stream 11 flows via further orifices 19 in the radial wall 20 directly into the cross-sectional jumps 15, where annular stabilization prevails, and there serves, as required, for cooling and for intensification. Said orifices 16, which are distributed in the axial direction and in the circumferential direction of the inflow zone 1, thus as a whole cover the entire inflow zone 1 and ensure that the inner wall 3 can be cooled with a low consumption of air. In addition, this cooling air 12 forms on the inside of the inflow zone 1, that is to say along the inner liner of the wall 3, a thin thermal insulation layer which appreciably reduces the heat load on this wall 3 and which guarantees a large-area introduction of the air used for cooling purposes into the main mass flow of the working gases 8 with good mixing-in. This insulation layer guarantees, furthermore, that the pre-mixing flame required does not travel upstream in the flow boundary layer on the wall as far as the location of the jetting-in of fuel, where it would then burn in a diffusion-like manner. The concept of a combustion chamber with auto-ignition combustion low in harmful substances is thereby effectively promoted. Because the predominant part of the initial cooling air 10 is introduced into the mass flow of the working gases, upstream of the flame front 13, with a temperature which is now relatively high, in the combustion zone 2 it participates equally in the treatment to form hot gases 9, as a result of which non-uniformities of temperature, which could impair auto-ignition, especially in the part-load operating mode, are avoided. The small part of cooling air which is jetted into the cross-sectional jumps 15 exhibits no non-uniformities, but on the contrary, in that region, this cooling air promotes the convective cooling of the combustion zone 2 which is particularly weakened especially on account of the flow deflection occurring there and the cross-sectional widening between the cooling-air channel 18 and interspace 17. In an auto-ignition combustion chamber cooled in this way, the ratio of the total cooling air 10 required to the mass flow 8 flowing through the combustion chamber can be reduced to below 10%, without the possibility that appreciable mechanical loads on the inner walls 3 and 5 will occur as a result of the pressure loss in the cooling channel 18. In order to decrease the heat load on the vortex elements 7, it is advantageous if these are hollow, that is to say form a continuation of the inner wall 3 of the inflow zone 1, as is evident as an alternative from the figure. The flow-facing bend forming the vortex elements is likewise provided regularly with orifices 16, through which the cooling air 11 flows into the interior of the inflow zone 1 and likewise brings about an effusion-cooling effect there. In the case of specific flow ratios, the orifices 16 in the wall 3, through which the cooling air flows into the inflow zone 1, are provided obliquely in the direction of flow, so that the already mentioned cooling-air film formation on the inner liner experiences stronger bonding. The oblique setting of the orifices 16 depends on the intensity of the flow-related breakaway phenomenon in the formation of the cooling-air film.

Obviously, numerous modifications and variations of the present invention are possible in light of the above teachings. It is therefore to be understood that, within the scope of the appended claims, the invention may be practiced otherwise than as specifically described herein.

What is claimed is:

1. A process for cooling an auto-ignition combustion chamber of a gas-turbine set, said combustion chamber having an inflow zone and a combustion zone, the combustion zone having a greater cross-sectional area than the inflow zone with a transition step therebetween and a wall of the inflow zone having a plurality of holes, the process comprising the steps of:

introducing a working gas of temperature sufficiently high for ignition of a fuel into the combustion chamber through the inflow zone;

introducing a fuel into the working gas in the combustion chamber, wherein the fuel and working gas mix in the combustion chamber and auto-ignition of the mixture occurs;

directing cooling air through the holes in the wall of the inflow zone for effusion cooling; and directing cooling air on a wall of the combustion zone for convective cooling.

2. The process as claimed in claim 1, wherein cooling air is directed through cooling air passages formed on the wall of the combustion zone for convective cooling of the combustion zone wall, the cooling air flowing countercurrent to the working gas in the combustion zone, and wherein the cooling air is subsequently directed through the holes for the effusion cooling of the inflow zone.

3. The process as claimed in claim 1, wherein the fuel is introduced into the working gas in the inflow zone so that a flame front occurs at the transition step between the inflow zone and the combustion zone, and wherein the flame front is stabilized by a backflow formed in the combustion zone at the transition step.

4. The process as claimed in claim 1, wherein a backflow zone is formed in the inflow zone in the region of the flame front by a plurality of vortex-generating elements disposed in the inflow zone upstream of a point where the fuel is introduced.

5. The process as claimed in claim 4, wherein cooling air is directed to flow through holes in the vortex-generating elements for effusion cooling.

6. The process as claimed in claim 1, wherein the cooling air entering through the holes in the inflow zone forms an insulating layer on an inner surface of the combustion chamber.

7. The process as claimed in claim 1, wherein the transition step include a plurality of holes and cooling air is also directed through the transition step holes.

* * * * *